US009612034B1

(12) United States Patent
Lasevski

(10) Patent No.: US 9,612,034 B1
(45) Date of Patent: Apr. 4, 2017

(54) AIR CONDITIONER WATER DROP NOISE BLOCKER

(71) Applicant: Zdislav David Lasevski, New York, NY (US)

(72) Inventor: Zdislav David Lasevski, New York, NY (US)

( * ) Notice: Subject to any disclaimer, the term of this patent is extended or adjusted under 35 U.S.C. 154(b) by 0 days.

(21) Appl. No.: 14/932,093

(22) Filed: Nov. 4, 2015

(51) Int. Cl.

| | |
|---|---|
| ***F24F 13/20*** | (2006.01) |
| ***F25D 21/14*** | (2006.01) |
| ***F24F 13/22*** | (2006.01) |
| ***F28C 1/16*** | (2006.01) |
| ***F24F 13/24*** | (2006.01) |
| ***F24F 1/02*** | (2011.01) |

(52) U.S. Cl.
CPC ..... *F24F 13/24* (2013.01); *F24F 1/027* (2013.01)

(58) Field of Classification Search
CPC ..... F24F 13/24; F24F 2013/247; F24F 1/027; F24F 13/20; F24F 13/22; F28C 1/10; F28C 1/16; F25D 21/14; Y10S 261/85; Y10S 165/212; F23L 17/14
USPC ..... 261/DIG. 85; 181/220, 221
See application file for complete search history.

(56) References Cited

U.S. PATENT DOCUMENTS 2,901,989 A * 9/1959 Mondi ..... F24F 13/20 52/23
3,426,866 A * 2/1969 Jensen ..... F16L 55/033 181/224
4,215,080 A * 7/1980 Ribier ..... F28C 1/10 261/111
4,328,176 A * 5/1982 Alt ..... F28C 1/10 261/111
4,416,835 A * 11/1983 Bosne ..... F28F 25/04 261/110
4,521,350 A * 6/1985 Lefevre ..... F28F 25/04 261/111
4,730,423 A * 3/1988 Hughes ..... E04D 13/0335 135/87
4,991,406 A * 2/1991 Fujii ..... F24F 1/56 62/259.1
5,159,789 A * 11/1992 Haapanen ..... E04D 13/08 52/12
5,386,702 A * 2/1995 Wiesen ..... F24F 13/24 181/198

(Continued)

FOREIGN PATENT DOCUMENTS

BR 200301021 A * 3/2004
BR 0301021 A * 12/2004
BR 0301021 * 5/2011

OTHER PUBLICATIONS

Machine Translation of Abstract BR 0301021 A, De Luca, Dec. 2004.*

*Primary Examiner* — Frantz Jules
*Assistant Examiner* — Martha Tadesse
(74) *Attorney, Agent, or Firm* — Michael J. Feigin, Esq.; Feigin & Fridman

(57) ABSTRACT

Eliminating a noise from water dropping on an air conditioner unit is disclosed. This device has an upper panel with a layer of plastic material on a surface, a lower panel having a layer of plastic material on a surface, and a hinge. The lower panel includes a plurality of magnets for attachment to the air conditioner unit. The upper and lower panels are bent at a certain angle so water droplets slide on the upper panel surface, in embodiments of the invention.

1 Claim, 15 Drawing Sheets

(56) References Cited

U.S. PATENT DOCUMENTS

| | | | | | |
|---|---|---|---|---|---|
| 5,655,382 | A * | 8/1997 | Chen | F24F 1/58 | 206/216 |
| 5,657,582 | A * | 8/1997 | Chitwood | E04D 13/08 | 138/109 |
| 5,663,536 | A * | 9/1997 | Kaplan | F28C 1/10 | 181/224 |
| 5,958,306 | A * | 9/1999 | Curtis | F28F 25/02 | 261/112.2 |
| 5,979,172 | A * | 11/1999 | Teller | F24F 13/224 | 62/277 |
| 6,644,061 | B1 * | 11/2003 | Woolfson | E04D 13/008 | 62/259.1 |
| 6,892,851 | B2 * | 5/2005 | Lee | E04F 17/04 | 165/135 |
| 8,210,308 | B2 * | 7/2012 | Penner | F04D 29/664 | 181/224 |
| 9,299,332 | B2 * | 3/2016 | Je | G10K 11/002 | |
| 2004/0060769 | A1 * | 4/2004 | Hentschel | F28C 1/10 | 181/220 |
| 2005/0056481 | A1 * | 3/2005 | Mafi | F24F 1/12 | 181/202 |
| 2009/0166902 | A1 * | 7/2009 | Lee | F28C 1/02 | 261/159 |

* cited by examiner

AIR CONDITIONER WATER DROP NOISE BLOCKER

SUMMARY OF THE INVENTION

A device for eliminating a noise from water dropping on an air conditioner unit is disclosed. This device has an upper panel with a layer of plastic material on a surface, a lower panel having a layer of plastic material on a surface, and a hinge. The lower panel includes a plurality of magnets for attachment to the air conditioner unit. The upper and lower panels are bent at a certain angle so water droplets slide on the upper panel surface, in embodiments of the invention.

DETAILED DESCRIPTION

Figure 1:
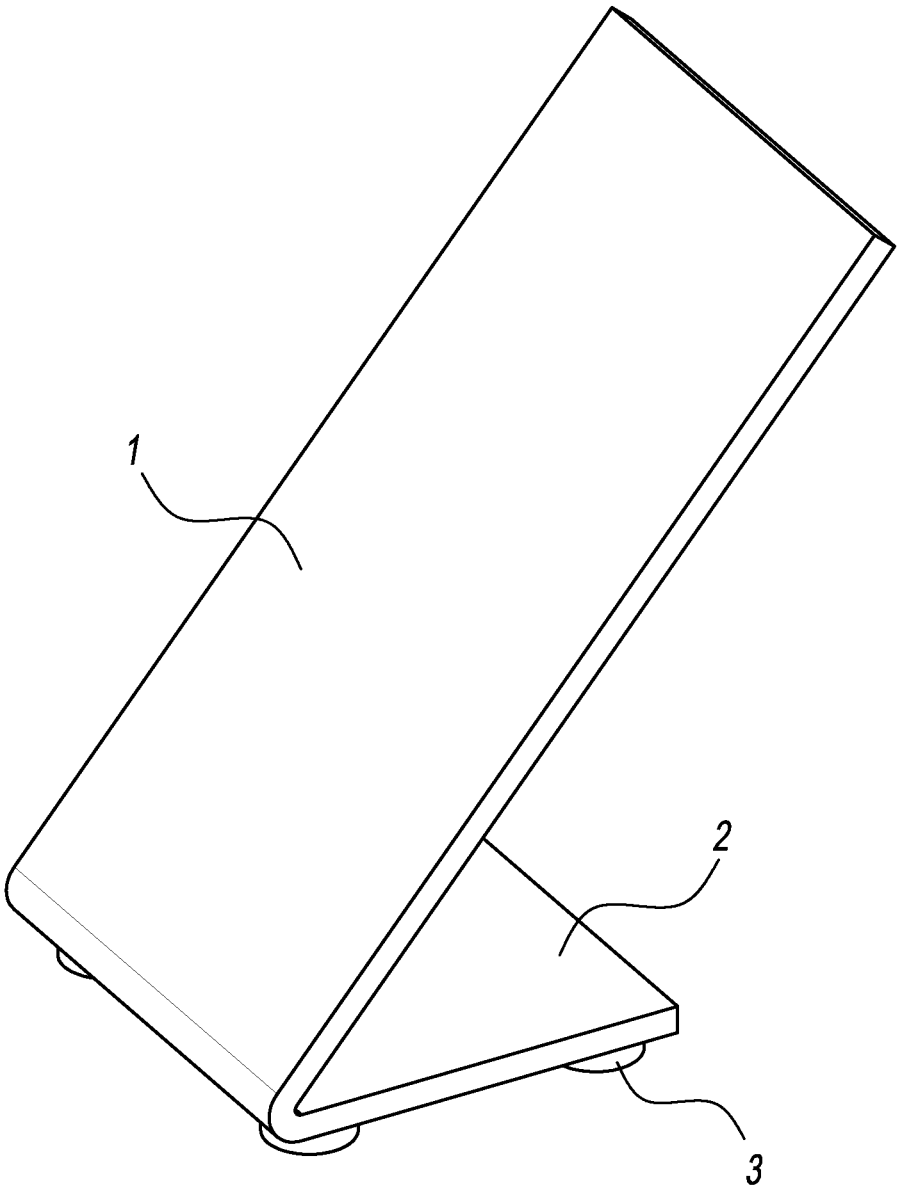
FIG. 1 shows the device in its full view where part 1 is the length of the device which is in upright position, part 2 is base of the device, part 3 are magnets attached to the device base.
Figure 2:
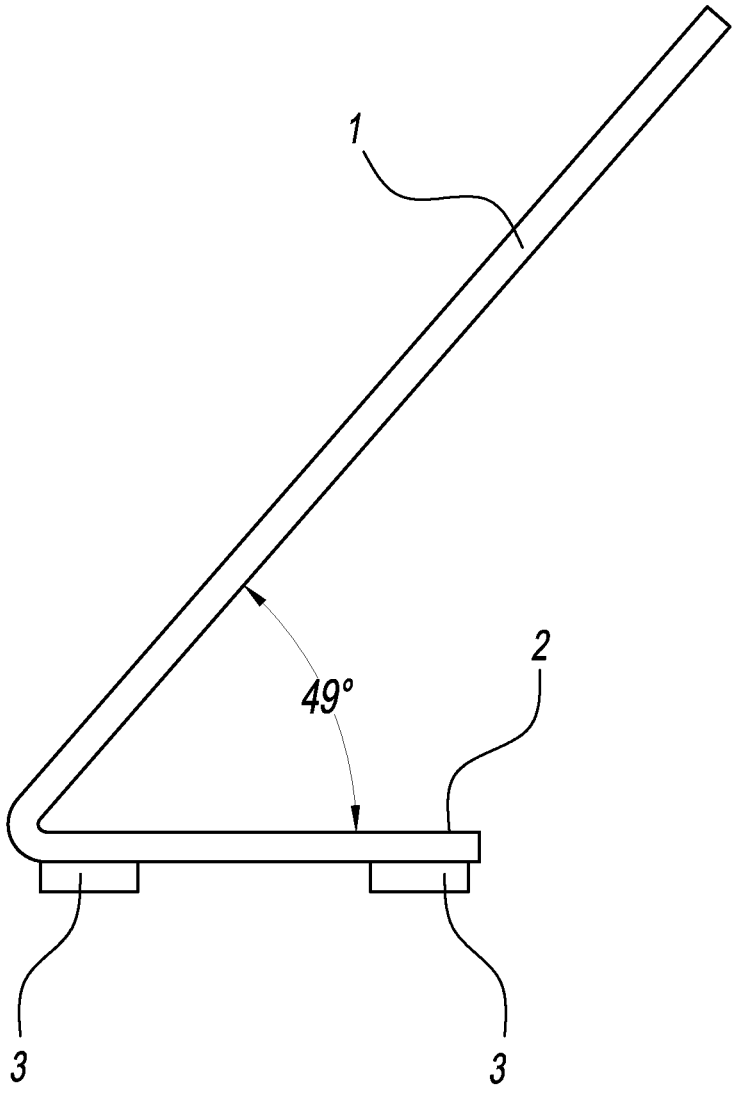
FIG. 2 shows the side view of the device. This view shows the vertical part 1 bend to 49 degree angle. The angle is between the base of the device (part 2) and its length (part 1). Part 1 is the length of the device which is in upright position, part 2 is base of the device, part 3 are magnets attached to the device base.
Figure 15:
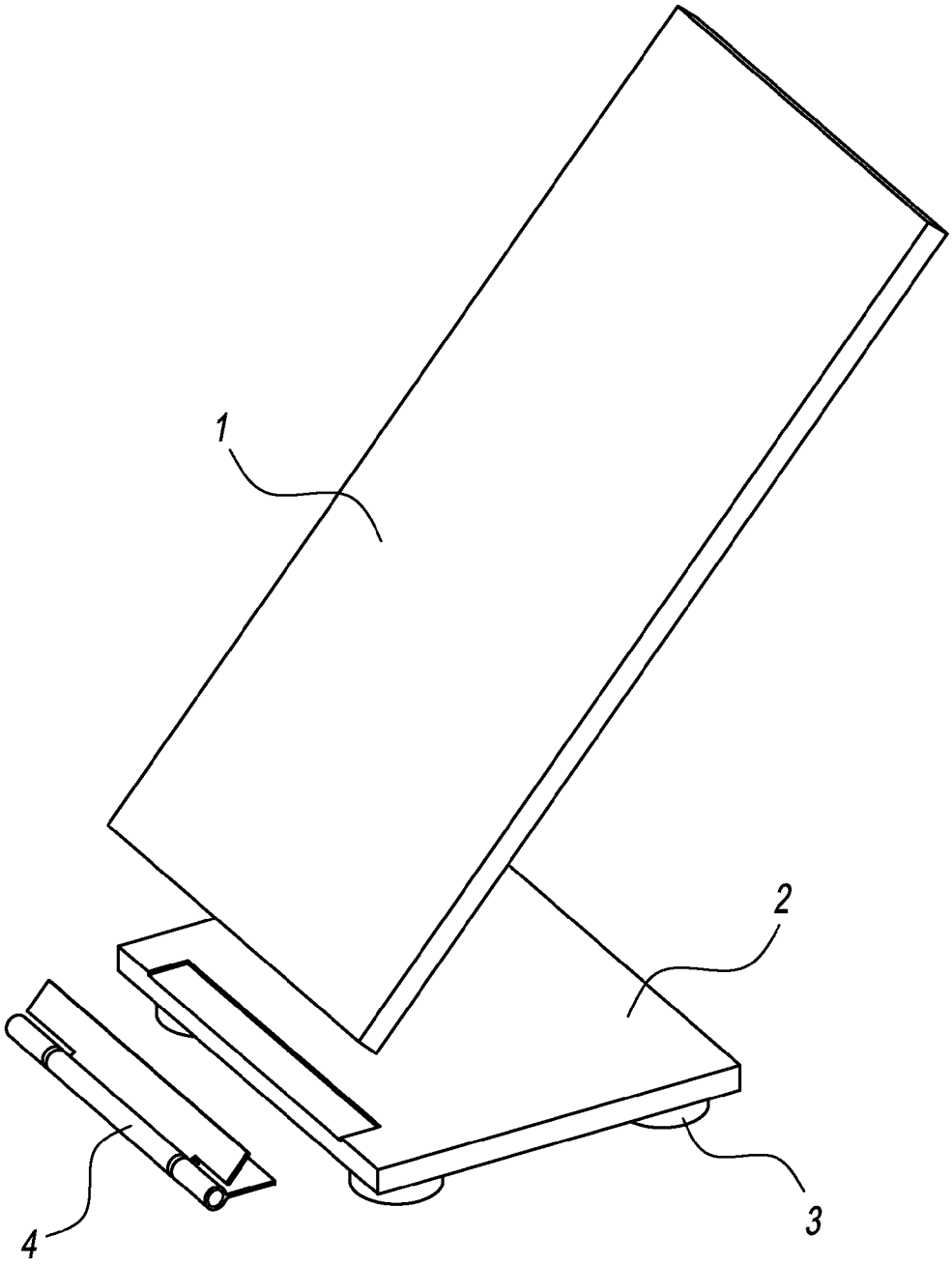
FIG. 15 shows the length of the device (part 1), base of the device (part 2), magnets attached to the device base (part 3), and hinge (part 4).
Figure 16:
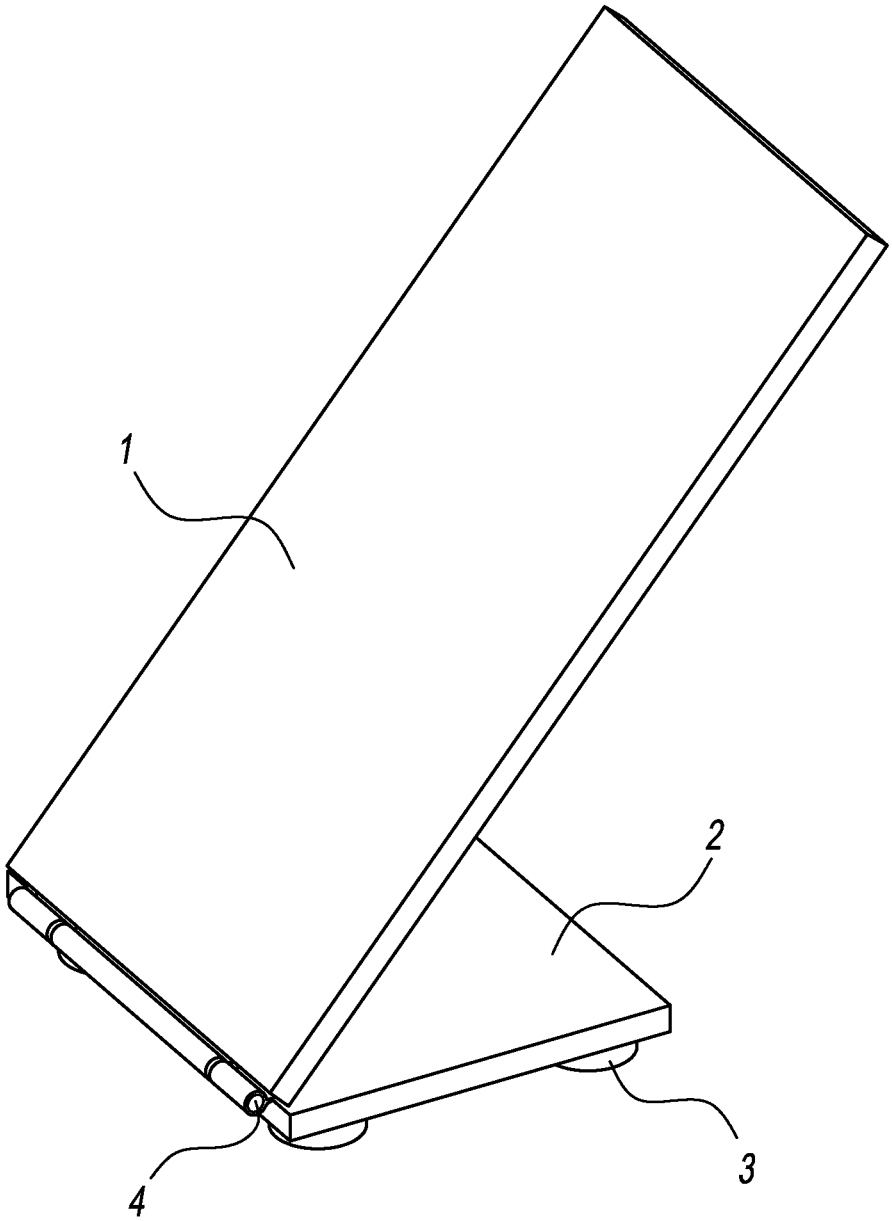
FIG. 16 shows the device in its upright position seen from the angle, where part 1 is the length of the device, part 2 is base of the device, part 3 are magnets attached to the device base and part 4 is hinge.
Figure 17:
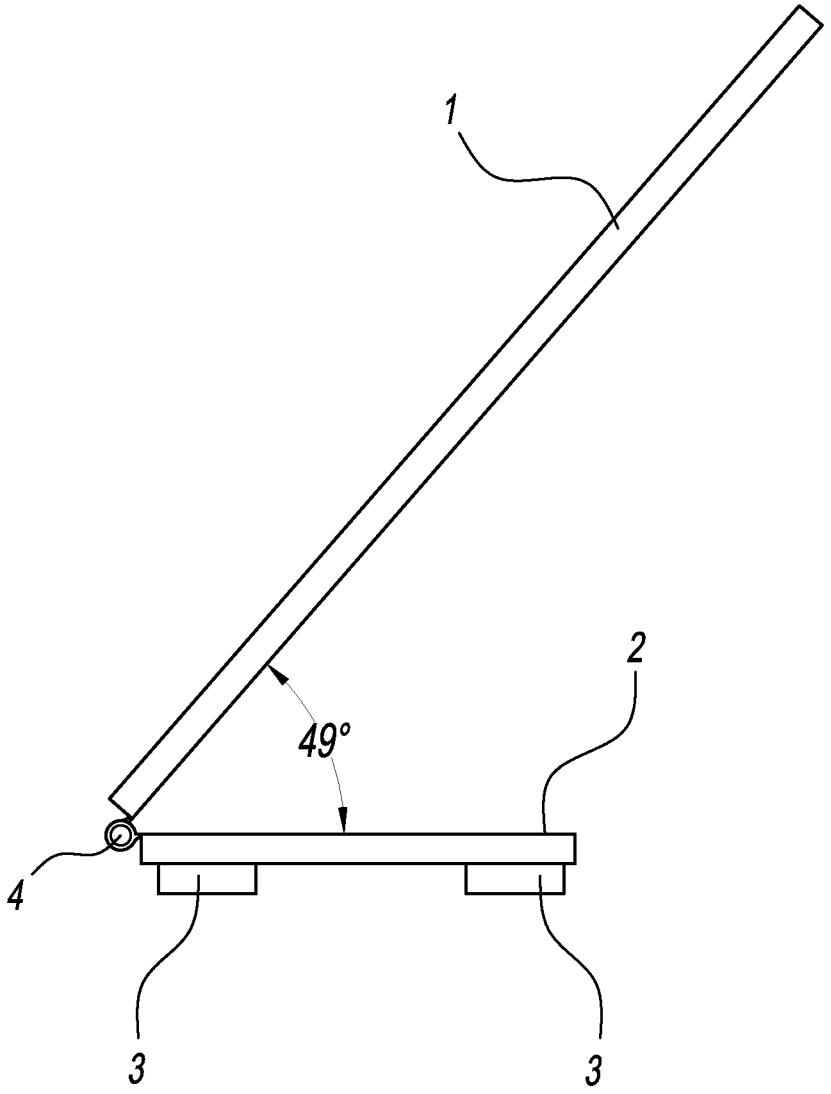
FIG. 17 shows the device with the hinge (part 4) connecting the base of the device (part 2) with its length (part 1). Part 3 are magnets attached to the device base. Hinge is set on the 49 degree angle.

The device fully shown in FIG. 1 eliminates noise from the water dripping on the air conditioner unit from another unit located above, or from the falling rain drops and it can be made from plastic or various material. Material used for the device needs to be bendable (FIG. 2) or connected from two pieces with hinges 4 (as show in the FIG. 15) or different methods to a 49 degrees angle or close to it (as shown on the side view of the device in FIG. 2 and FIG. 17). The option to adjust to that degree so the water drops falling on its bend angle will slide and gently fall on the air conditioner surface without making a noise or close to eliminating the noise.

Figure 3:
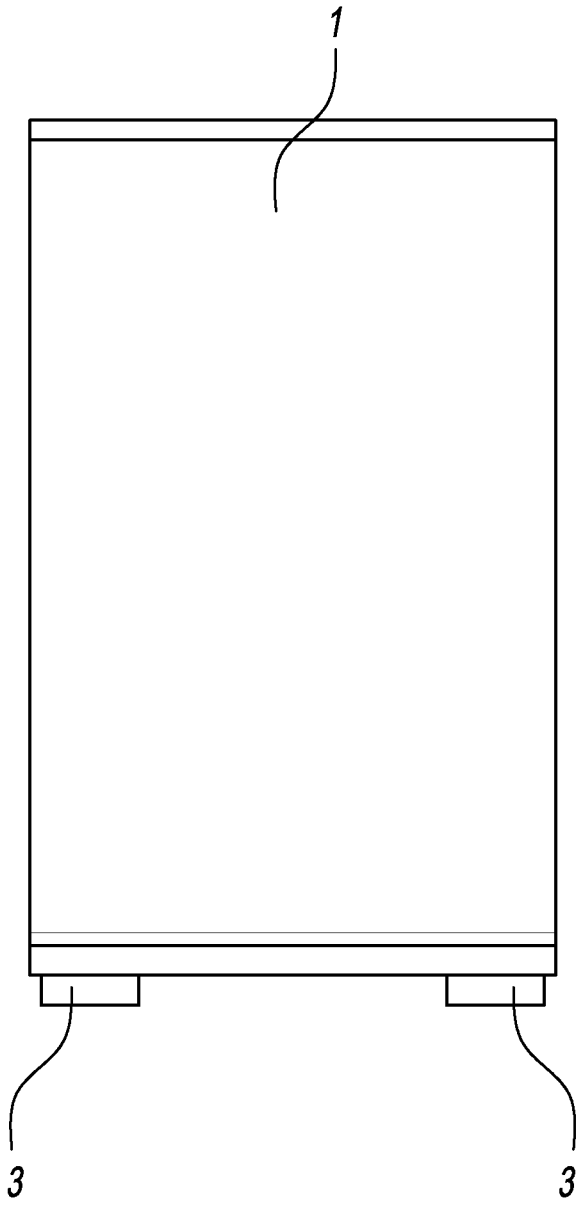
FIG. 3 shows the front view of the device where part 1 is the length of the device which is in upright position, and part 3 are magnets attached to the device base.
Figure 4:
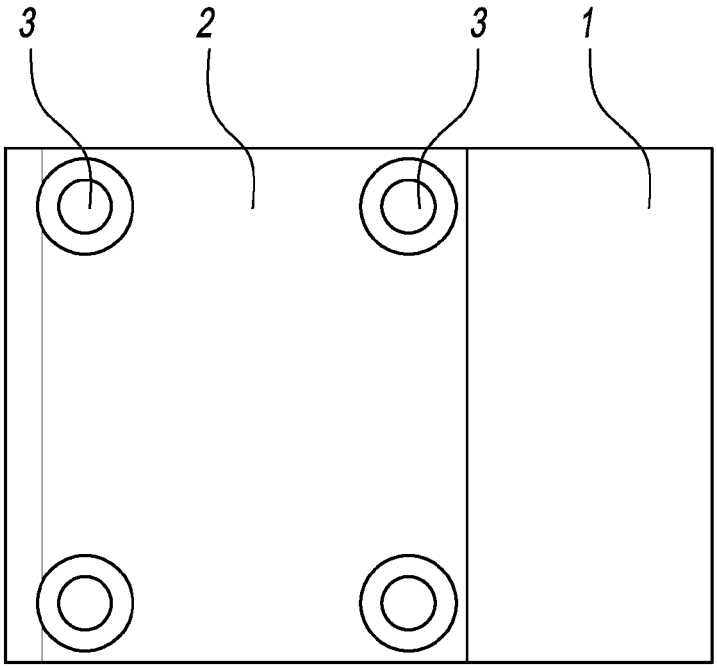
FIG. 4 shows the bottom view of the device laying sideways where part 3 are magnets attached to the device base (part 2). Part 1 applies to the length of the device which is sticking out on the right side.
Figure 5:
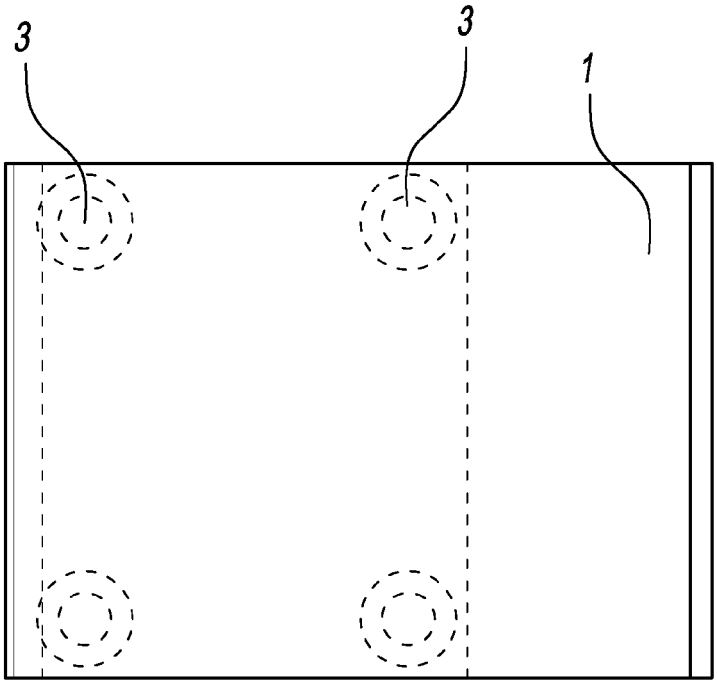
FIG. 5 shows the view of the device laying sideways where you look on it from front where part 3 are magnets located in each corner of the device and part 1 is the length of the device which is in upright position.
Figure 6:
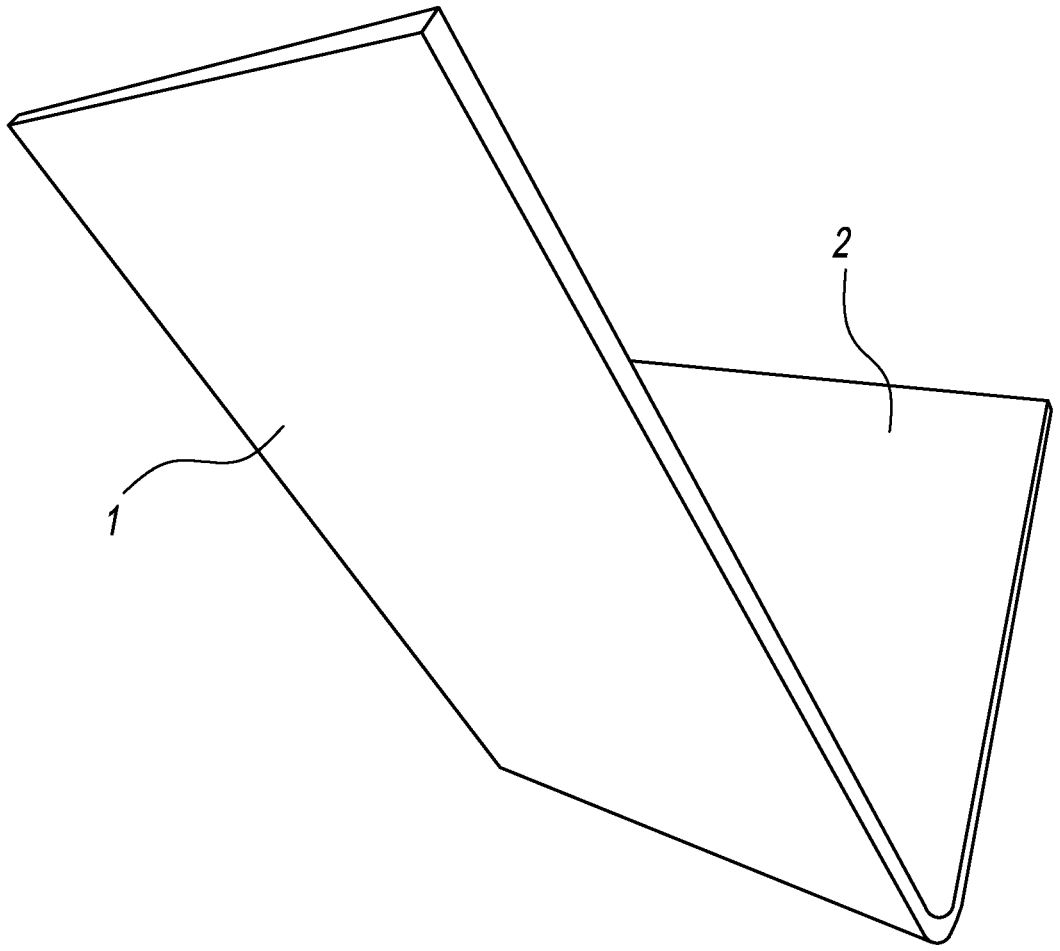
FIG. 6 shows the device from top where upright surface is visible (part 1) and base is visible (part 2). The device is bend to the 49 degree angle between the base (part 2) and the length of the device (part 1).
Figure 7:
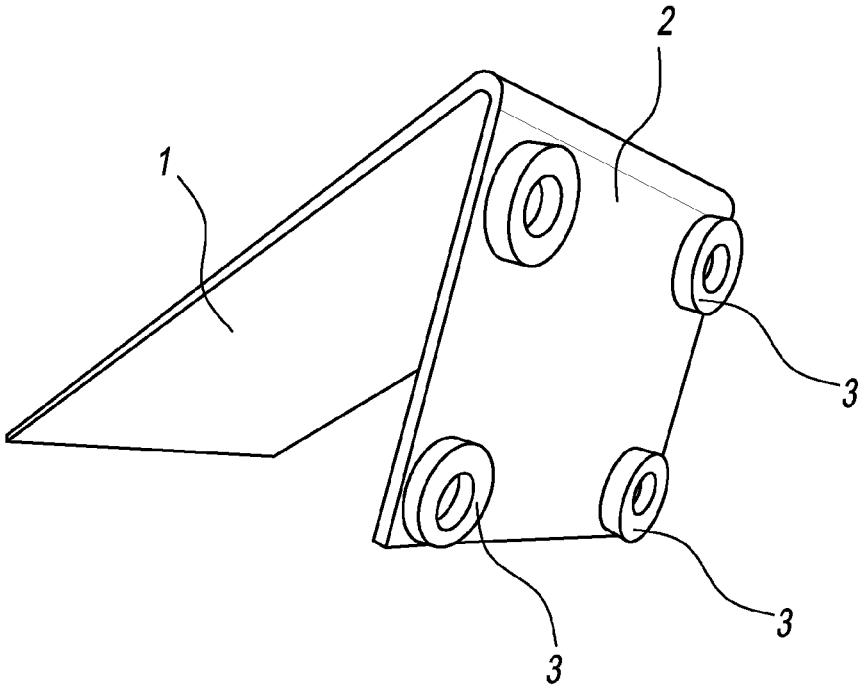
FIG. 7 shows the device laying sideways on the angle, where part 1 is the length of the device facing down and part 2 is base of the device laying vertical, part 3 are magnets attached to the device base.
Figure 8:
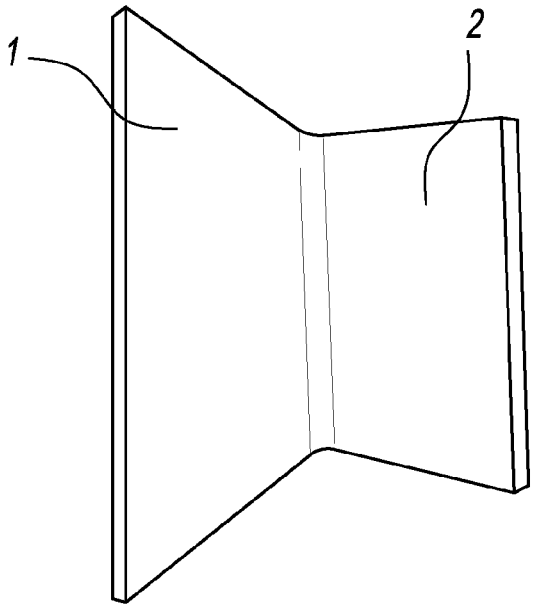
FIG. 8 shows the device from the top view where its length (part 1) is in the vertical position and base (part 2) in horizontal position.
Figure 9:
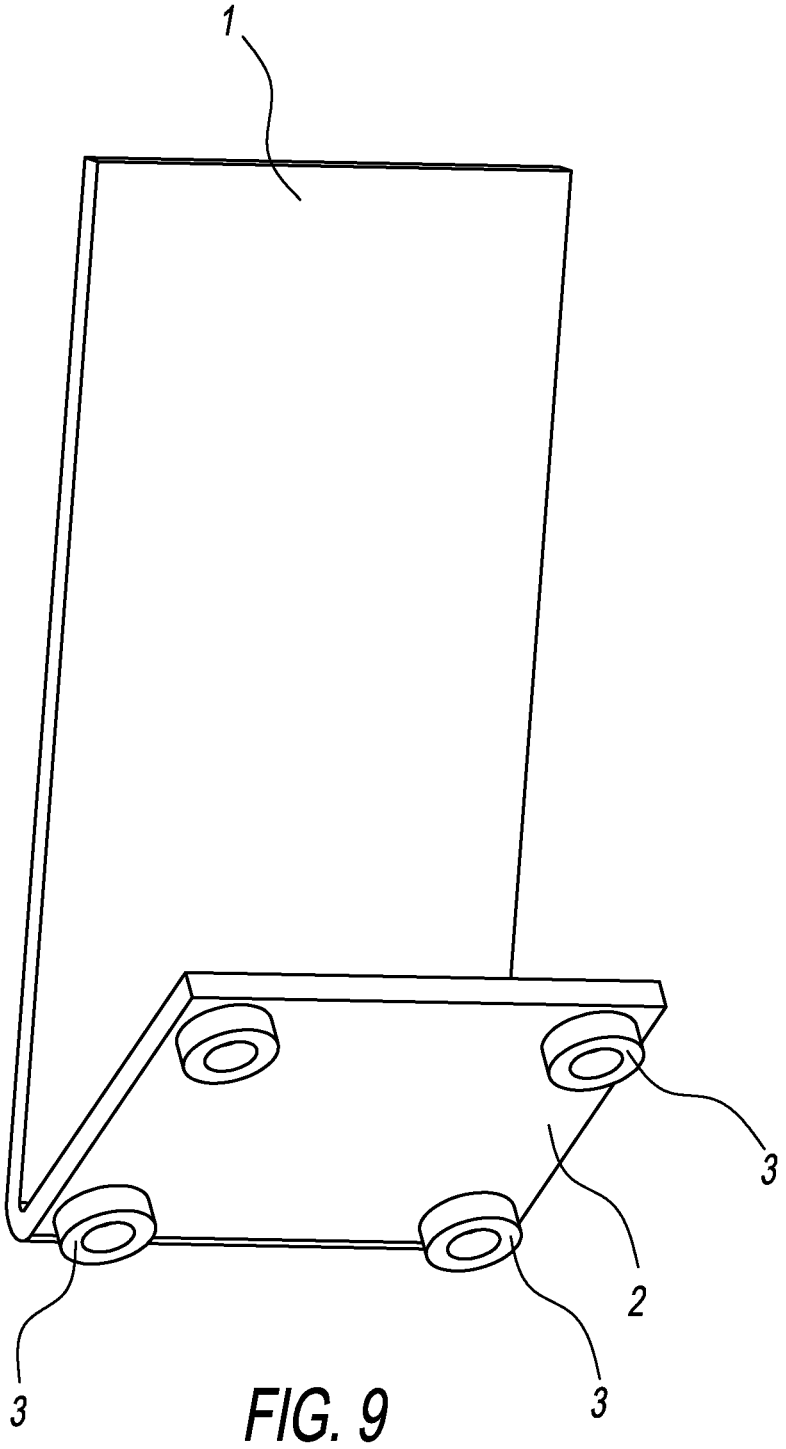
FIG. 9 shows the device tilted backwards where part 1 is the length of the device which is in upright position, part 2 is base of the device, part 3 are magnets attached to the device base.
Figure 10:
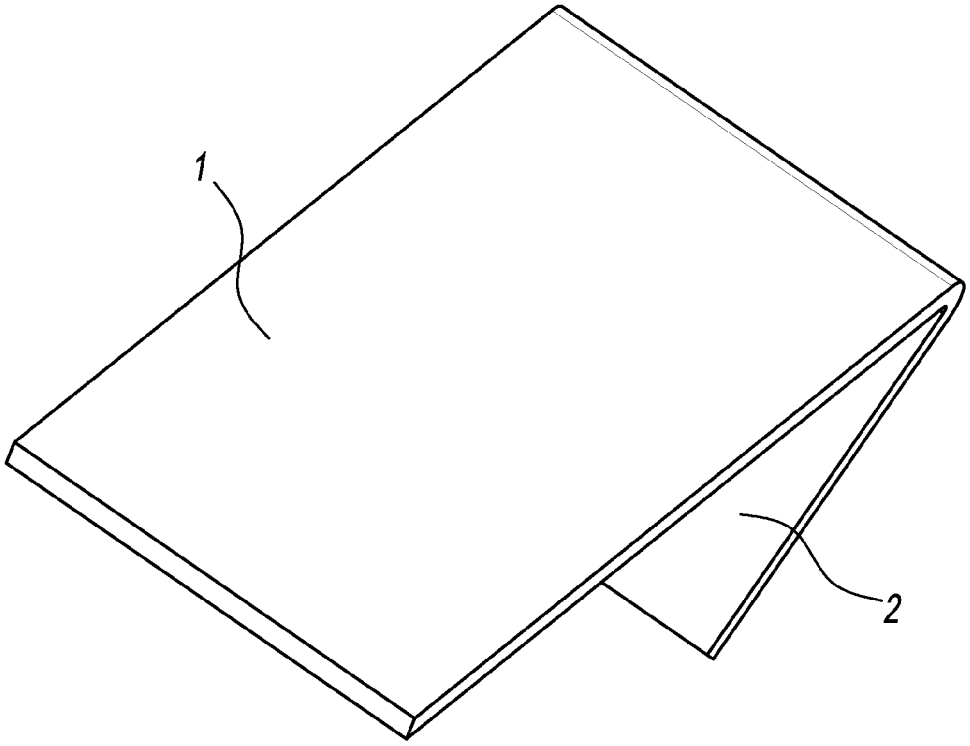
FIG. 10 shows the device from top where the upright surface is visible (part 1) and base is visible (part 2).
Figure 11:
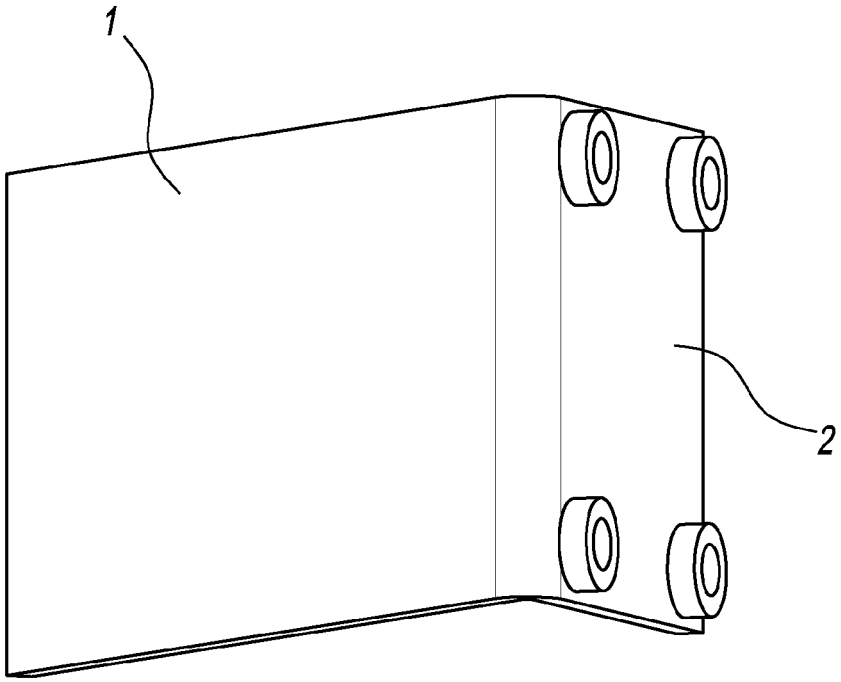
FIG. 11 shows the device laying sideways on the angle, where part 1 is the length of the device facing down and part 2 is base of the device laying vertical.
Figure 12:
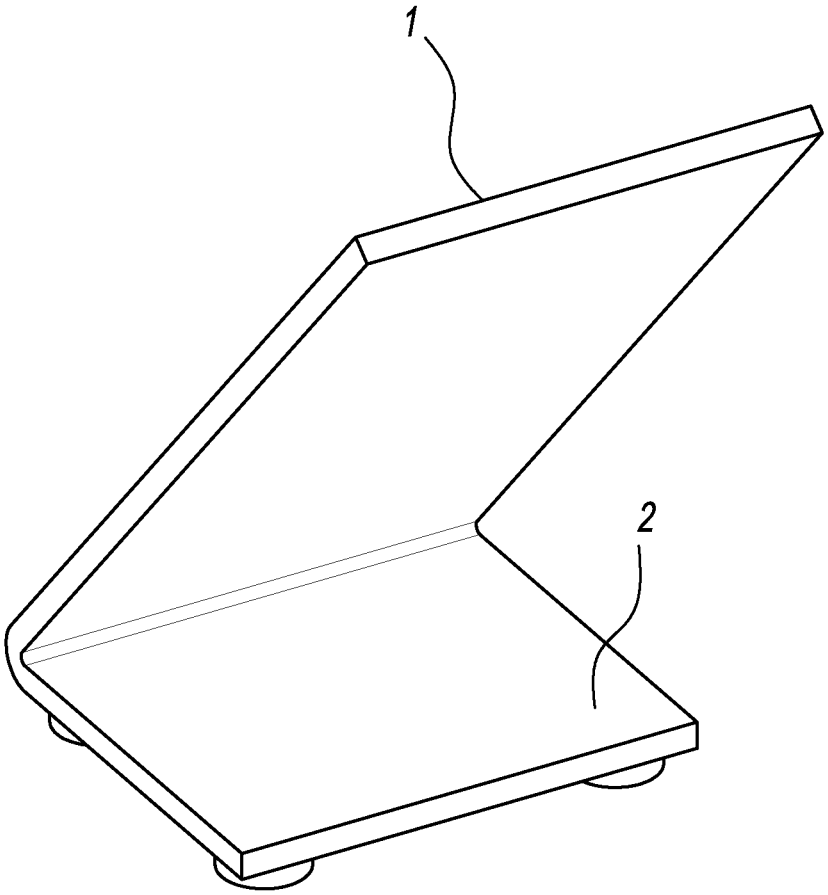
FIG. 12 shows the device standing in the straight position from back view where part 1 is the length of the device which is in upright position, part 2 is base of the device.
Figure 13:
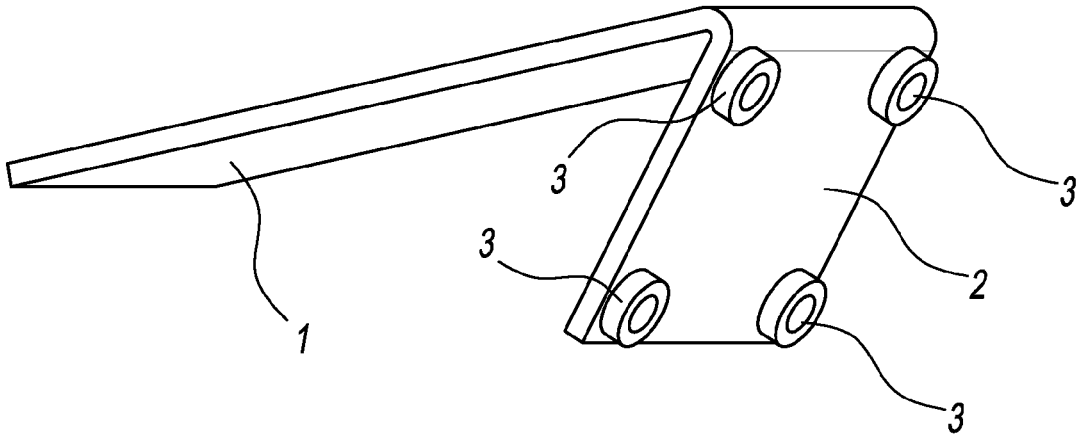
FIG. 13 shows the device laying sideways on the angle, where part 1 is the length of the device facing down and part 2 is base of the device laying vertical, part 3 are magnets attached to the device base.
Figure 14:
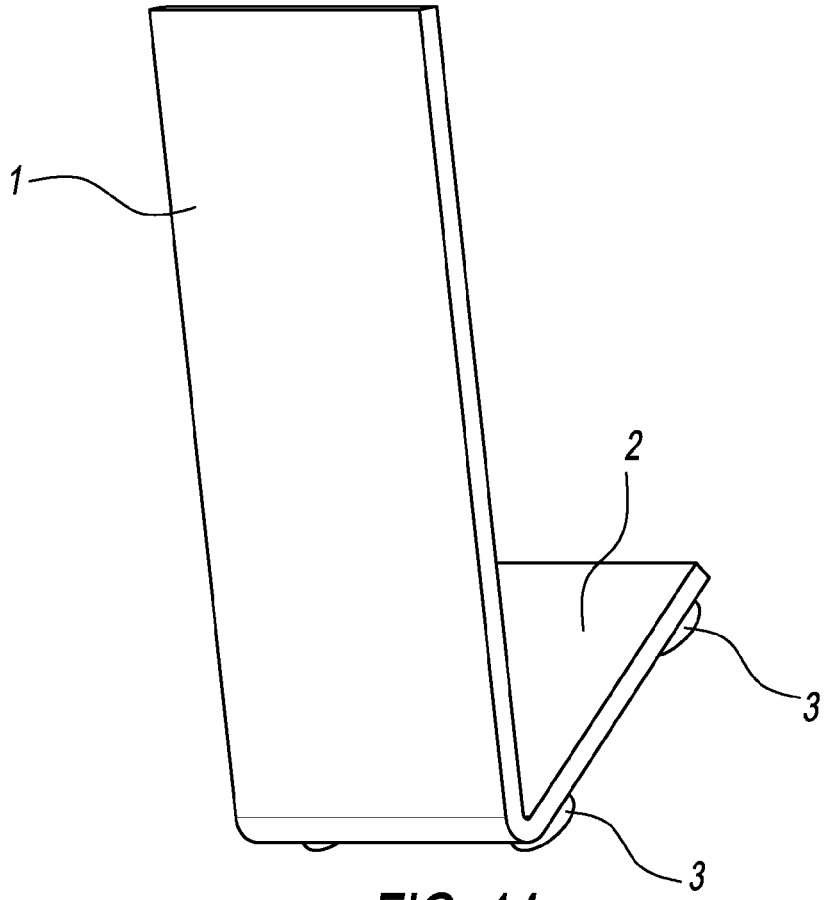
FIG. 14 shows view of the device from front on the angle where part 1 is the length of the device in upright position, part 2 is base of the device, part 3 are magnets attached to the device base.
Figure 18:
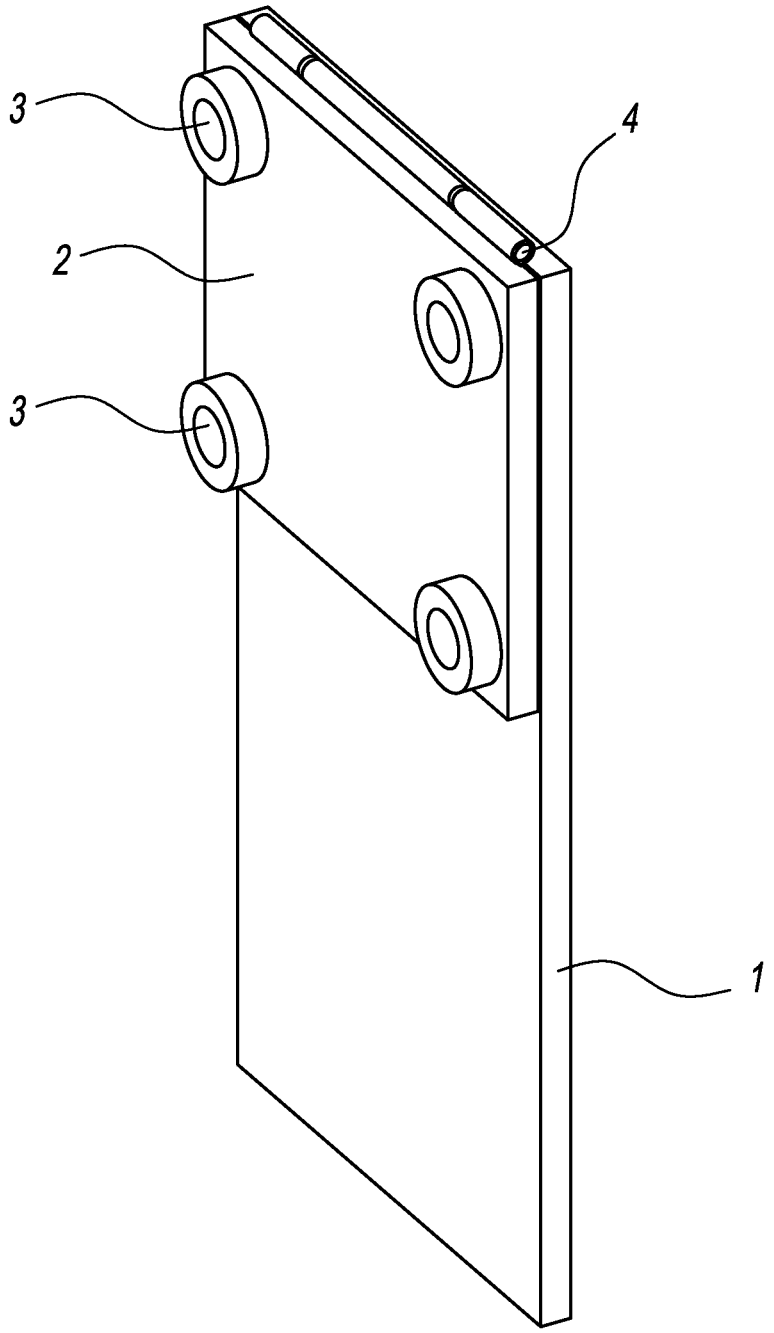
FIG. 18 shows the device folded in the upright position where part 1 is the length of the device, part 2 is base of the device, part 3 are magnets attached to the device base, part 4 is a hinge.
Figure 19:
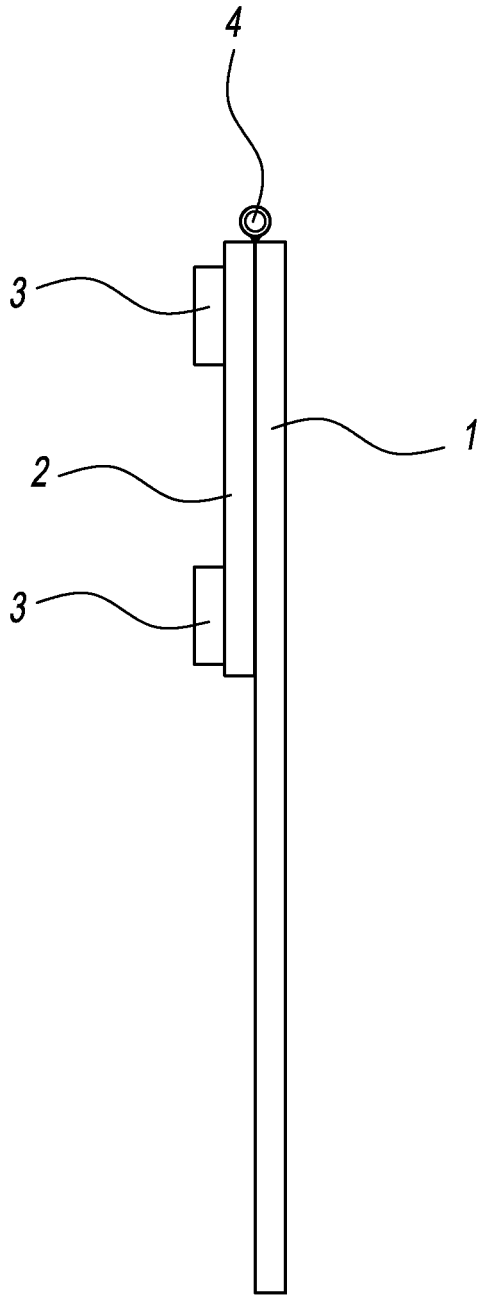
FIG. 19 shows the device folded from the side view where part 1 is the length of the device, part 2 is base of the device, part 3 are magnets attached to the device base, part 4 is a hinge.

When the device is made out of plastic, that plastic needs to be warmed up with a heat gun to the point when it starts to bend when pressure is applied. When the device is made from two pieces connected with the hinge 4 (see FIG. 15) that device can be folded (see FIG. 18 and FIG. 19) in case there is a strong wind. The front of the device shown in FIG. 3 is in the shape of the rectangle with its longer side pointing up. The base of the device 2 (shown in FIG. 4 and FIG. 5) has to be attached to the air conditioner by magnets 3 located in the corners of the device base or another means of attachments. The number of magnets vary according to the size of the device. The length 1 of the device can vary according to the amount of surface which the drop is falling on. It can be short, and in that case, the device will need to be positioned in the spot that the water dripping from the air conditioner unit located above will fall directly on the device and slide on the surface of the air conditioner. Or, the device can be as long as the length of the air conditioner to eliminate that the prior described step. Longer devices, or use of several smaller devices, are required to eliminate the noise from drops of rain falling on the air conditioner surface. There is photo that shows layout of the air conditioner units in one of the complex apartments (photo 1), and the are two photos that shows the device mounted on the top of the air conditioner units in different sports (photo 2, photo 3). Various drawings shows the unit from side, front and bottom view (FIG. 6 to FIG. 12 and FIG. 16) where part 1 is the length of the device, part 2 is the base of the device, part 3 are the magnets, and part 4 is a hinge). The view from bottom of the device is also shown in FIG. 13 and a view from front of the device is shown in FIG. 14. The device can be used for different reasons but it will give the result of water sliding from its angled surface will not make a noise when falling on the top of the air conditioner.

The invention claimed is:

1. A noise reduction device from water dripping on an air conditioner unit comprising:

an upper panel having a layer of plastic material on a surface thereof;

a lower panel having a layer of plastic material on a surface thereof; and a hinge;

wherein the lower panel includes a plurality of magnets for attached to the air conditioner unit; and wherein the upper and lower panels are bent at an angle causing water droplets to slide on said upper panel surface.

* * * * *